United States Patent [19]

Maher et al.

[11] Patent Number: 4,833,966

[45] Date of Patent: May 30, 1989

[54] LOW INERTIA LINEAR LINKLESS AMMUNITION FEEDING SYSTEM

[75] Inventors: David L. Maher, So. Hero; David N. Watt, So. Burlington, both of Vt.

[73] Assignee: General Electric Company, Burlington, Vt.

[21] Appl. No.: 155,797

[22] Filed: Feb. 16, 1988

[51] Int. Cl.[4] ..... F41D 10/18

[52] U.S. Cl. ..... 89/33.16; 89/34

[58] Field of Search ..... 89/33.17, 33.16, 33.35, 89/34

[56] References Cited

U.S. PATENT DOCUMENTS

| | | | |
|---|---|---|---|
| 3,974,738 | 8/1976 | Meyer | 89/34 |
| 4,004,490 | 1/1977 | Dix et al. | 89/34 |
| 4,166,408 | 9/1979 | Wetzel et al. | 89/34 |
| 4,424,735 | 1/1984 | Bacon et al. | 89/34 |
| 4,433,609 | 2/1984 | Darnall | 89/34 |
| 4,573,395 | 3/1986 | Stoner | 89/33.16 |

FOREIGN PATENT DOCUMENTS

| | | | |
|---|---|---|---|
| 2446462 | 9/1980 | France | 89/33.16 |

*Primary Examiner*—Deborah L. Kyle
*Assistant Examiner*—Stephen Johnson
*Attorney, Agent, or Firm*—Bailin L. Kuch; Robert A. Cahill

[57] ABSTRACT

A linear linkless ammunition feeding system includes a magazine in which a major portion of an endless ammunition conveyor is supported in serpentine formation on upper and lower sets of opposed rails. Screw feeder elements convey this serpentine formation linearly to an exit end of the magazine where the serpentine conveyor loops thereof are successively unwrapped from the rails by a first shuttle mechanism and accelerated to conveyor gun firing velocity. A second, identical shuttle mechanism stationed at the entrance end of the magazine decelerates the conveyor coming from the gun and wraps it into serpentine loops on the rails.

20 Claims, 3 Drawing Sheets

LOW INERTIA LINEAR LINKLESS AMMUNITION FEEDING SYSTEM

The present invention relates to a system for dispensing articles from storage at high velocities and is specifically directed to feeding linkless rounds of ammunition from a magazine to a machine gun or cannon at a rapid firing rate.

BACKGROUND OF THE INVENTION

In the typical linear linkless ammunition feeding system, the individual rounds of ammunition are accommodated in separate carriers which are serially interconnected to form a conveyor. This conveyor is trained throughout the interior of the magazine in a manner to maximize packing density and exits the magazine to deliver the rounds seriatim to the gun. At some point in this delivery, the rounds are picked from the conveyor carriers and loaded into the gun for firing. In many gun system applications, it is required that the spent shell casings be saved rather than simply ejected from the system. In such case, the conveyor is typically made endless, and the spent shell casings are successively returned to the carriers of the conveyor for conveyance back into the magazine and stored.

An ammunition handling system of this linear linkless type is disclosed in Stoner U.S. Pat. No. 4,573,395, wherein an endless ammunition conveyor is trained in a serpentine or folded accordian path through a magazine. The conveyor exits the magazine at one end to deliver live rounds to a rapid-fire gun and re-enters the magazine at the other end carrying spent rounds for storage. It will be appreciated that, in systems of the type disclosed in this patent, the entire conveyor must be driven at a requisite high velocity to satisfy the rapid firing rate of modern gun systems. This requires a large and powerful conveyor driving source, particularly where large ammunition is concerned. In addition, the power source must possess the further capacity to rapidly accelerate the entire conveyor and its ammunition cargo from a standing start to the full gun firing rate velocity. A magazine fully loaded with live rounds represents considerable inertia to be overcome during such rapid acceleration.

To reduce the requisite conveyor velocity without prejudicing gun firing rate, resort has made to a two-bay or two-tier conveyor arrangement wherein the rounds of ammunition are conveyed to the gun in pairs. This approach theoretically reduces the conveyor speed by one-half relative to a given gun firing rate, but adds the complexity and cost of a merging mechanism for picking off each round of the pair for successive delivery to the gun. This merging mechanism also represents and additional source of power consumption. The linear linkless ammunition feeding system disclosed in Bacon et al. U.S. Pat. No. 4,424,735 is representative of this "tiered" feeding approach.

Another approach to reducing the velocity of the bulk of the ammunition feeding motion is disclosed in Darnall U.S. Pat. No. 4,433,609. In this system, an ammunition round carrying conveyor is suspended at spaced points along its length from elevated, opposed side rails, such that the intervening segments of the conveyor hang loosely and uncontrollably from the suspension points as depending loops or pleats. As the gun fires, the conveyor loop segments are successively drawn off the exit ends of the side rails and thus freed for the delivery of rounds to the gun. Thus, only the freed conveyor loop segments travel at the high velocity to satisfy a rapid firing rate, while the suspended conveyor loop segments traverse the magazine toward the exit ends of the side rails at a significantly reduced velocity. The ammunition conveyor of this Darnall patent is open ended and thus cannot return fired shell casings to the magazine for storage. Moreover, loading the magazine with live rounds is strictly a time-consuming manual procedure.

It is accordingly an object of the present invention to provide an improved ammunition feeding system.

A further object is to provide an ammunition feeding system of the above-character which is capable of accommodating rapid gun firing rates.

Another object is to provide a linear linkless ammunition feeding system of the above-character wherein motive power requirements are dramatically reduced.

A still further object is to provide a linear linkless ammunition feeding system of the above-character, wherein the inertial load resisting the rapid acceleration of the feeding system to full gun firing rate is significantly reduced.

An additional object is to provide a linear linkless ammunition feeding system of the above-character which not only conveys live ammunition rounds from a magazine to a gun, but conveys spent shell casings back to the magazine for storage.

Yet another object is to provide a linear linkless ammunition feeding system of the above-character wherein the storage of live ammunition rounds and spent shell casings within the magazine is effectively controlled.

A further object is to provide a linear linkless ammunition system of the above-character which is economical in construction, efficient in operation, and reliable over a long useful life.

Other objects of the invention will in part be obvious and in part appear hereinafter.

SUMMARY OF THE INVENTION

In accordance with the present invention, there is provided an ammunition feeding system of the linear linkless type comprising a magazine through which is trained in serpentine formation an endless conveyor equipped with ammunition round-accommodating carriers uniformly distributed along its length. This ammunition conveyor emerges through an exit in the magazine to successively deliver live ammunition rounds to a rapid-fire gun and successively accepts in exchange spent shell casings for conveyance back into the magazine through an entry thereof.

The magazine is equipped with sets of opposed, linear rails for supporting at spaced intervals each of the depending serpentine loops of that portion of the ammunition conveyor arranged in serpentine formation within the magazine. A first, reciprocating shuttle mechanism, stationed at the exit of the magazine, includes cooperating sets of drive sprockets operating to successively unwrap serpentine conveyor loops from their supporting rails and accelerate them to conveyor rapid gun-firing velocity. A second, reciprocating shuttle mechanism, stationed at the entry of the magazine, includes cooperating sets of drive sprockets operating to decelerate the returning ammunition conveyor from gun-firing velocity and wrap it as serpentine conveyor loops on the supporting rails.

The reciprocations and sprocket speeds of the first, unwrapping shuttle mechanism and the second, wrapping shuttle mechanism are coordinated for smooth ammunition feeding operation. In addition, a secondary conveyor, driven in coordination with the shuttle mechanisms, linearly conveys the serpentine formation portion of the ammunition conveyor en masse from the wrapping shuttle mechanism to the unwrapping shuttle mechanism at an appropriate velocity dramatically less than conveyor gun-firing velocity.

The invention accordingly comprises the features of construction, combination of elements and arrangement of parts, all of which will be exemplified in the construction hereinafter set forth, and the scope of the invention will be indicated in the claims.

BRIEF DESCRIPTION OF THE DRAWINGS

For a better understanding of the nature and objects of the invention, reference may be had to the following detailed description taken in connection with the accompanying drawings, in which.

Corresponding reference numerals refer to like parts throughout the several views of the drawings.

DETAILED DESCRIPTION

Figure 1:
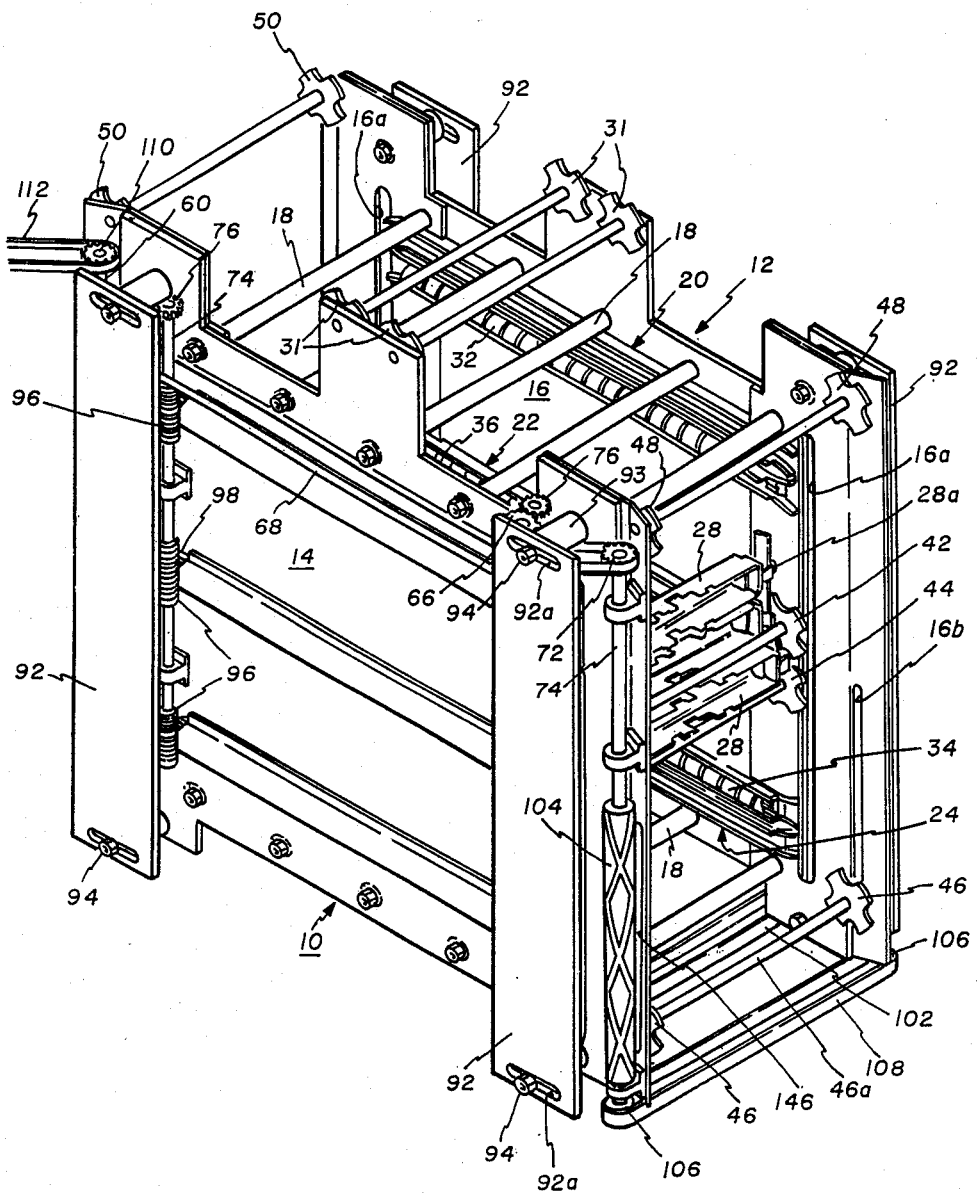
FIG. 1 is a perspective view of a linear linkless ammunition feeding system constructed in accordance with the present invention.
Figure 3:
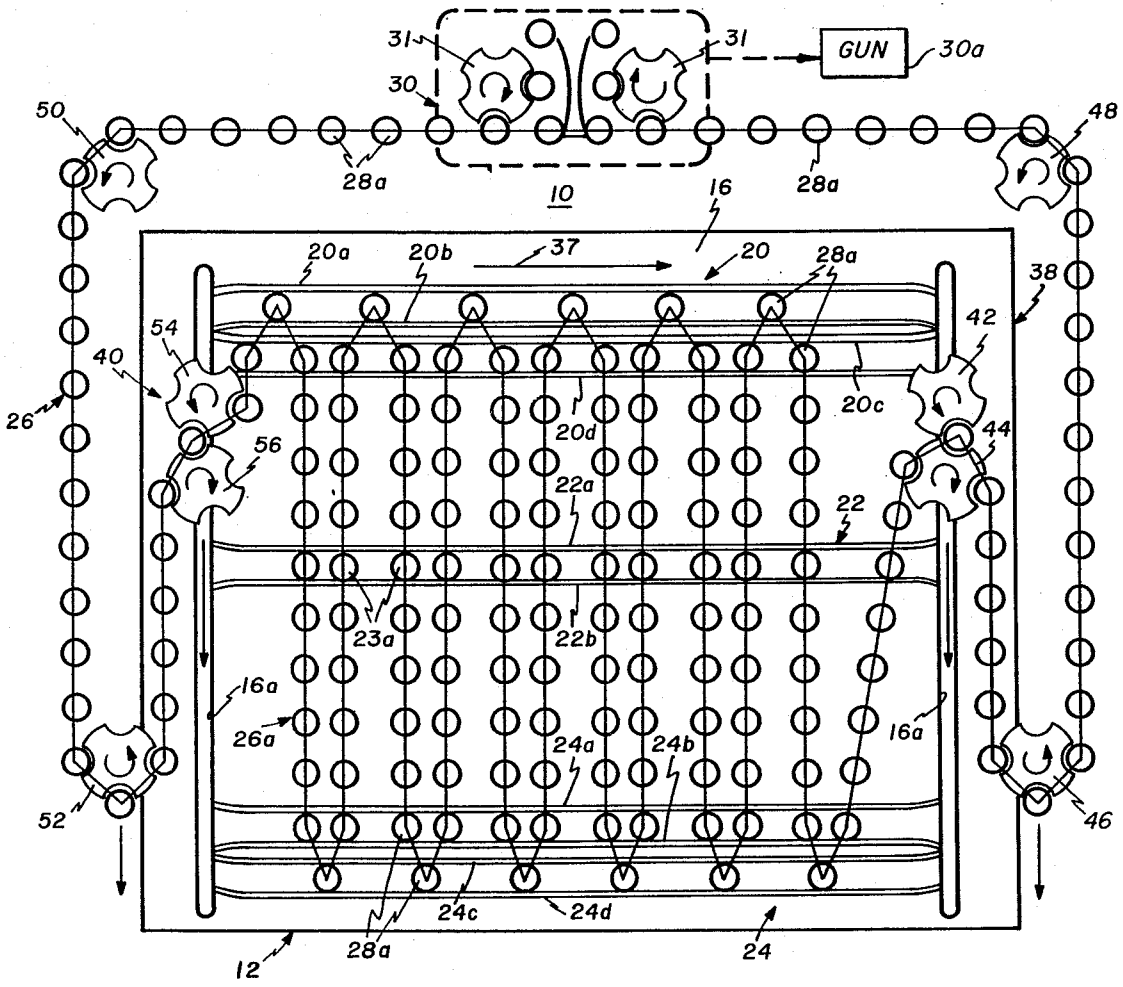
FIG. 3 is a schematic diagram illustrating the operation of the ammunition feeding system of FIG. 1.

The linear linkless ammunition system, generally indicated at 10 in FIG. 3, includes a magazine generally indicated at 12, whose overall construction can best be appreciated from FIG. 1. As seen therein, the magazine includes a front wall 14 and a back wall 16 which are maintained in spaced, parallel relation by a multiplicity of tie rods 18. Mounted to the interior sides of the front and back walls in opposed relation are upper, intermediate and lower parallel sets of linear rails, generally indicated at 20, 22, and 24 respectively. Only the back wall rail sets can be seen in FIG. 1, and their full longitudinal extend can be appreciated from FIG. 3. Each upper rail set 20 includes four coextensive, vertically spaced, parallel rails **20*a*, 20*b*, 20*c* and 20*d*; each intermediate rail set 22 includes two coextensive, vertically spaced, parallel rails 22*a* and 22*b*; and each lower rail set 24 includes four coextensive, vertically spaced, parallel rails 24*a*, 24*b*, 24*c* and 24*d***.

As seen in FIG. 3, these opposed rail sets serve to support within the confines of magazine 12 a major segment of an endless ammunition conveyor, generally indicated at 26, in a serpentine formation, generally indicated at **26*a*. This ammunition conveyor may be and preferably is of the type disclosed in the commonly assigned Wetzel et al. U.S. Pat. No. 4,166,408, the disclosure of which is specifically incorporated herein by reference. Thus, conveyor 26 is comprised of an endless series of pivotably interconnected cradles or carriers, several being illustrated at 28 in FIG. 1, each accommodating a single round of ammunition, not shown. Each carrier is equipped with resilient means (not shown) for securely retaining the ammunition round until it arrives at a suitable stripper-feeder, generally indicated at 30 in FIG. 3, which is stationed proximate a pair of idler sprocket sets 31 rotatably mounted by the front and back magazine walls. The stripper-feeder successively picks the ammunition rounds from the arriving carriers for conveyance to rapid-fire gun 30*a*** and successively deposits fired shell casings into the departing, just emptied carriers. It is understood that the stripper-feeder and rapid-fire gun are not material to the present invention and have been omitted from the text and drawings in the sake of brevity.

Rotatably mounted at each end of each carrier is a roller **28*a* (FIGS. 1 and 3) by which the ammunition conveyor is supported by the front and back wall rail sets in serpentine formation 26*a*. Thus, as seen in FIG. 3, three consecutive opposed carrier rollers 28*a* are captured between rails 20*c* and 20*d* and between rails 20*a* and 20*b* of opposed upper rail sets 20 to provide support and longitudinal guidance for each upper fold or turnaround of the conveyor serpentine loops comprising formation 26*a*. Similarly, three consecutive opposed carrier rollers are captured between rails 24*a* and 24*b* and between rails 24*c* and 24*d* of opposed lower rail sets 24 for the support and longitudinal guidance of the lower folds or turnarounds of each conveyor serpentine loop. For enhanced control of the serpentine conveyor loops, opposed carrier rollers at the midpoints between the upper and lower folds are captured between rails 22*a* and 22*b* of the opposed intermediate rails sets 22. Disposed between rails 20*c* and 20*d* of the opposed upper rail sets 20 are coextensive screw feeder elements, one seen at 32 in FIG. 1, which are respectively rotatably mounted by the front and back magazine walls. Similarly, second, identical, longitudinally elongated screw feeder elements 34 are respectively rotatably mounted by the front and back magazine walls at locations between rails 24*a* and 24*b* of opposed lower rail sets 24. In addition, third screw feeder elements 36, also rotatably mounted by the front and back magazine walls, are disposed coextensively between rails 22*a* and 22*b* of opposed intermediate rail sets 22. These screw feeder elements 32, 34 and 36 engage the opposed, rail-captured carrier rollers and are commonly driven in the manner described below to produce a controlled mass propagation or conveyance of the serpentine loops of formation 26*a* from left to right as indicated by arrow 37** in FIG. 3.

Stationed at the right or exit end of magazine 12 (FIG. 3) is a first, unwrapping shuttle mechanism, generally indicated at 38, which is vertically reciprocated between the upper, intermediate, and lower opposed rail sets and operates to pick off the opposed carrier rollers **28*a* from these rails as they are conveyed to the exit or right ends thereof by the screw feeder elements 32, 34 and 36. An identical, second shuttle mechanism, generally indicated at 40 and stationed at the left of entry end of the magazine, is vertically reciprocated between the upper, intermediate, and lower opposed rail sets and operates to insert opposed carrier rollers between these rails at their left or entry ends. The unwrapping shuttle mechanism 38 and the wrapping mechanism 40** are driven in synchronous, in-phase relation, such that, as the former is picking carrier rollers from the rails to, in effect, progressively unwrap a serpentine loop at the right end of the serpentine formation, the latter is inserting carrier rollers onto the rails to, in effect, progressively form or wrap a serpentine loop at the left end of the serpentine formation. As each serpentine loop is formed, the screw feeder elements convey it to the right, making room on the rails for the next serpentine loop formation.

As seen diagrammatically in FIG. 3, unwrapping shuttle mechanism 38 is equipped with cooperating sets of drive sprockets 42 and 44 for engaging therebetween the conveyor carrier rollers 28*a* and forcibly drawing them off the exit ends of the rails. Shuttle mechanism 38 also includes a set of idler accumulator sprockets 46 which are also reciprocated, but at half the velocity and half the stroke length of sprockets 42 and 44. Thus, while the vertical stroke of sprockets 42 and 44 extends substantially the full height of magazine 12, the vertical stroke of sprockets 46 extends only to approximately the level of intermediate rail sets 22. Their reciprocations are in phase such that sprockets 42, 44 and sprockets 46 reach their respective upper and lower stroke limits simultaneously. From the unwrapping sprockets 42, 44, ammunition conveyor 28 is trained downwardly around accumulator sprockets 46, upwardly to and around a set of idler sprockets 48 journalled by the magazine front and back walls, across the top of the magazine past the idler sprocket sets 31 at stripper-feeder 30, and around a second set of magazine-mounted idler sprockets 50 to a set of accumulator sprockets 52 included with wrapping shuttle mechanism 40. This shuttle mechanism, being identical to unwrapping shuttle mechanism 38, thus further includes cooperating sets of drive sprockets 54 and 56 to which ammunition conveyor 26 is trained from accumulator sprockets 52 and between which the opposed carrier rollers 28*a* are engaged. As in the case of unwrapping drive sprockets 42, 44, wrapping drive sprockets 54, 56 are reciprocated through a vertical stroke extending the full height of the magazine to rack carrier rollers onto the opposed rail sets 20, 22 and 24, and thus wrap conveyor 26 into serpertine loops. The accumulator sprockets 52, like accumulator sprockets 46, are vertically reciprocated at half the velocity and half the stroke length of drive sprockets 54, 56, i.e., only from the level of the lower rail sets to approximately the level of the intermediate rail sets. Also, the reciprocations of sprockets 54, 56 and sprockets 52 are in-phase such that they simultaneously reach their respective upper and lower stroke limits. As noted previously, the reciprocations of the wrapping and unwrapping shuttle mechanisms are also driven in synchronous phase relation, such that all sprocket sets achieve their respective upper and lower stroke limits simultaneously.

It will be appreciated that, in addition to successively unwrapping the serpentine loops from the rails, sprockets 42, 44 are driven at a rate necessary to accelerate the unwrapped serpentine conveyor loops from essentially zero velocity up to the requisite velocity to satisfy the prevailing gun firing rate. It will be seen that sprockets 42 and 44 are only required to accelerate the mass of the unwrapped serpentine loop, which represents a small fraction of the total mass of the conveyor and the live and spent ammunition rounds carried thereby. This represents a dramatic savings in ammunition feeding power requirements. Sprockets 54 and 56 of wrapping shuttle mechanism 40, on the other hand, operate to decelerate the conveyor from gun-firing rate velocity to essentially zero as the carrier rollers are racked on the rails to form serpentine loops. The sets of accumulator sprockets 46 and 52 operate to take up conveyor slack during shuttle mechanism reciprocations. The bulk of the combined mass of conveyor 26 and its ammunition cargo is in serpentine formation 26*a* and is thus supported by the rails sets. Moreover, this serpentine formation portion of the ammunition conveyor need be conveyed by the screw feeding elements 32, 34 and 36 at a very low velocity, e.g., five to ten percent of the gun firing rate velocity. These factors further reduce the ammunition conveyor power requirements. For example, a 30 millimeter gun system utilizing the present invention with a 1000 round magazine capacity would consume less than one horsepower at a 2400 shots per minute firing rate. This compares to a power consumption of nearly twenty horsepower for the same gun system equipped with a conventional ammunition feeding system wherein the entire ammunition conveyor is accelerated up to and driven at gun-firing rate velocity.

Figure 2:
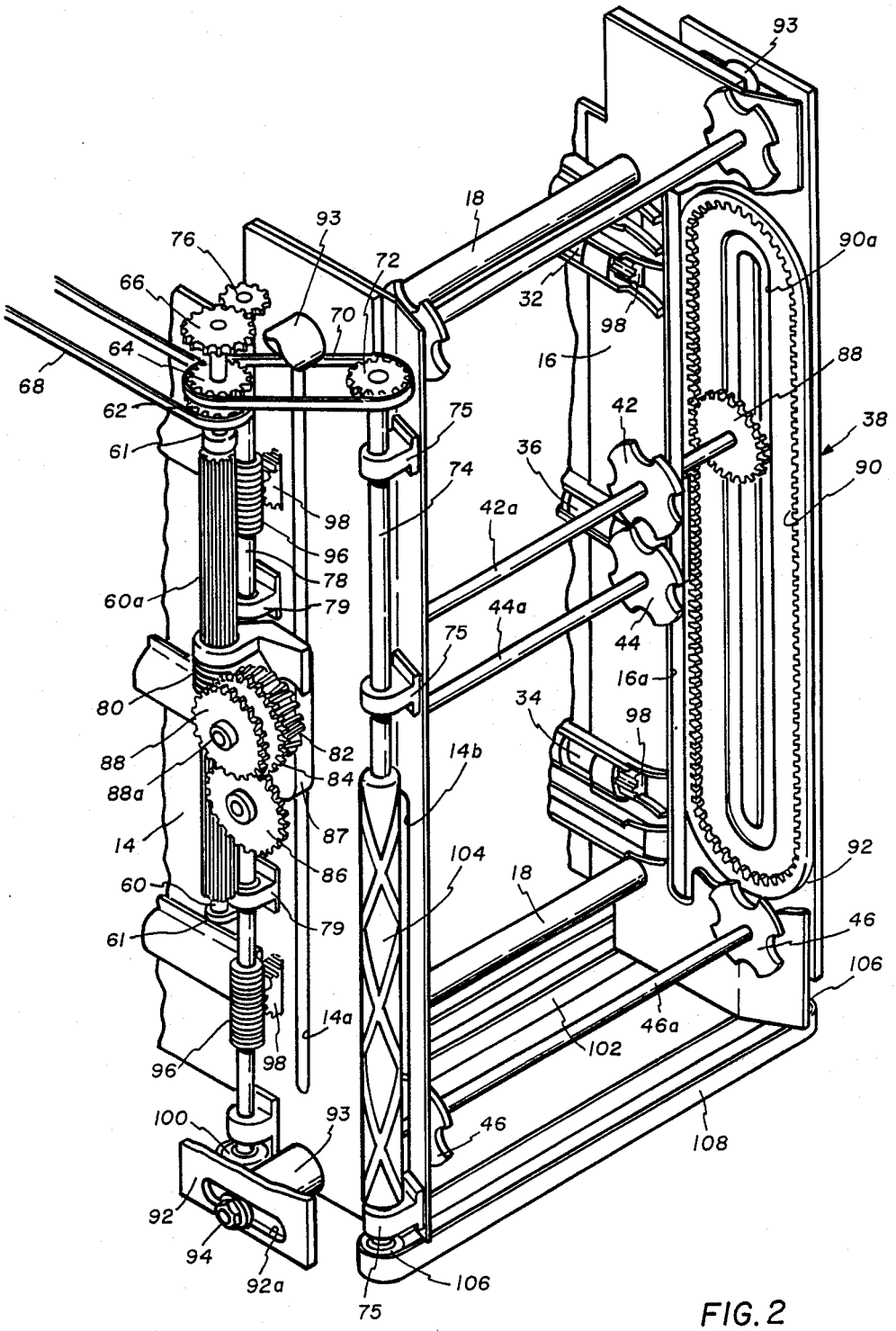
FIG. 2 is an enlarged fragmentary perspective view, partially broken away, of a portion of the ammunition feeding system of FIG. 1.

Turning to FIG. 2, to drive unwrapping shuttle mechanism 38, a first, vertically oriented shaft 60 is mounted by journals 61 to the exterior of front magazine wall 14 adjacent its right vertical edge. This shaft mounts a series of three spur gears 62, 64 and 66 adjacent its upper end. Gear 62 is engaged by a gear belt 68 to impart driving rotation to shaft 60. Gear 64 drives a gear belt 70 trained around a spur gear 72 affixed to the upper end of a vertically oriented second shaft 74 which is mounted by journals 75 to the front magazine wall. The third gear 66 meshes with a spur gear 76 affixed to the upper end of a vertically oriented shaft 78 which is mounted to the magazine front wall by journals 79. It is thus seen that all three shafts 60, 74 and 78 are rotated off the drive imparted by gear belt 68.

Shaft 60 carries an elongated spline section 60*a* on which is slidingly received a worm 80 in meshing engagement with a worm gear 82 carried on the end of the shaft 42*a* mounting the set of shuttle sprockets 42. This shaft, whose ends are extended through vertically elongated slots 14*a* and 16*a* in the front and back magazine walls 14 and 16, respectively, also carries a spur gear 84 which meshes with a spur gear 86 carried on the end of the shuttle sprockets 44 mounting shaft 44*a* also extending through wall slots 14*a* and 16*a*. These shafts 42*a*, 44*a* are journalled at their extending ends by tie blocks, the frontal one seen at 87 in FIG. 3, which serve to fix their vertically spaced relation and thus maintain the sets of shuttle sprockets 42, 44 in opposed carrier roller-engaging relation. An extension of front tie block 87 serves to mount worm 80. From this description, it is seen that shuttle sprockets 42 and 44 are driven off of shaft 60 in counter rotation to successively unwrap serpentine loops from the serpentine formation 26*a* and accelerate them to gun firing rate velocity.

Still referring to FIG. 2, shuttle sprocket shaft 42*a* carries at each end follower gears 88 which mesh with internal, vertically elongated racetrack-shaped gears, one seen at 90. These racetrack gears are affixed to plates 92, which, in turn, are spaced from the front and back magazine walls by standoff posts 93 to which they are loosely pinned by bolts 94 extending through longitudinally elongated plate slots 92*a*. By virtue of this mounting arrangement, the racetrack gears 90 are constrained against vertical movement, but are permitted a limited degree of longitudinal motion. The opposed racetrack gears are further formed with a recessed cam track 90*a*, of conforming racetrack shape, in which are received close-fitting, annular cam followers 88*a* carried at the very ends of shuttle sprocket shaft 42*a*. It will be appreciated that the cam followers are constrained to move only along the paths of their cam tracks, and thus serve to maintain follower gears 88 in continuous meshing engagement with their associated racetrack gears 90. Since these follower gears are being driven off of shaft 60, both rotation and vertical reciprocation of unwrapping shuttle sprockets 42 and 44 result. It will be noted that the racetrack gears are free to shift longitudinal positions as the follower gears negotiate the upper and lower turnaround gear sections thereof in effecting reversals in shuttle stroke direction. By virtue of this gearing arrangement the unwrapping shuttle sprockets are rotationally and reciprocatingly driven off the same drive shaft 60.

As also seen in FIG. 2, shaft 78 carries three vertically separated worms, the upper and lower ones seen at 96, which drivingly mesh with worm gears 98 carried on the ends of screw feeder elements 32, 34 and 36 operating in the front magazine wall-mounted upper, lower and intermediate rail sets 20, 24 and 22, respectively. To provide drive for the back magazine wall-mounted screw feeder elements 32, 34 and 36, a vertical shaft (not shown) analogous to shaft 78, is mounted thereto and also carries worms for drivingly engaging the three screw feeder element worm gears, two of which can be seen at 98 in FIGS. 2 and 3. These two shafts each carry spur gears, the frontal one seen at 100, which are drivingly interconnected by a gear belt 102. It is thus seen that all six screw feeder elements are also commonly driven off of shaft 60 to convey the serpentine formation portion of the ammunition conveyor toward the unwrapping shuttle mechanism.

It still remains to provide the reciprocating drive for accumulator sprockets 46 of the unwrapping shuttle mechanism. To this end, and as seen in FIG. 1 and 2, shaft 74 carries a level wind gear 104 which engages the frontal end of accumulator sprocket shaft **46*a* protruding through a vertically enlongated slot 14*b* in front magazine wall 14. This shaft 74 is duplicated beyond back magazine wall 16 to provide an identical level wind gear engaged by the rear end of accumulator sprocket shaft 46*a* protruding through a vertically elongated slot 16*b* in the back wall. Spur gears 106, affixed to the lower ends of these level wind gear shafts, are drivingly interconnected by a gear belt 108. As a result, the front and back level wind gears are driven in unison off of shaft 60 to reciprocate the accumulator sprockets 46 in coordination with the reciprocation of the unwrapping sprockets 42, 44** as described above.

The geartrain described above for driving the unwrapping shuttle mechanism 38 stationed at the exit or illustrated right end of magazine 12 is duplicated at the opposite or entry end of the magazine to drive wrapping shuttle mechanism 40 thereat. Shafts 60 of the frontal portion of the two geartrains are drivingly interconnected by gear belt 68, as seen in FIG. 1. As illustrated, shaft 60 of the wrapping shuttle mechanism geartrain is extended at its upper end so as to carry a spur gear 110 which is engaged by a gear belt 112 driven by a suitable prime mover (not shown) for the ammunition feeding system 10.

From the foregoing description, it is seen that the low inertia linear linkless ammunition feeding system of the present invention accommodates a dramatic reduction in the system prime mover power requirements. In addition to energy savings, reductions in prime mover size and weight are made possible, all of which are extremely important design considerations. It will be appreciated that the above-described shuttle mechanism drivetrains are merely illustrative and that modifications thereof in form or type will readily occur to those skilled in the art. While in the disclosed embodiment, the shuttle sprockets provide the sole means of driving the ammunition conveyor at the gun firing rate velocity, one or more of the illustrated sets of idler sprockets may also be driven to share this task. For certain applications, mid-level control and conveyance of the multiple serpentine loops may be unnecessary, permitting the omission of the intermediate rail sets 22 and the screw feeder elements 36 operating therein. While the screw feeder elements are illustrated as being driven at both ends, a single-ended drive may be found to work satisfactorily. It may also be found desirable to cushion the longitudinal position shifts of the racetrack gears 90 occurring when the shuttle sprockets reverse stroke directions. This would entail simply spring biasing the racetrack gears toward positions mid-way between their extreme longitudinal positions. In addition, rather than drivingly reciprocating the sets of accumulator sprockets 45, 52, it may be sufficient, particularly for small ammunition round sizes, to simply spring-bias them downwardly. While ammunition system 10 has been described with respect to the particular orientation shown in the drawings, it will be appreciated that it is operable in any spatial orientation.

It is seen that the objects set forth above, including those made apparent from the foregoing description, are efficiently attained, and, since certain changes may be made in the disclosed construction without departing from the present invention, it is intended the the details embodied therein shall be taken as illustrative and not in a limiting sense.

Having described the invention, what is claimed as new and desired to secure by Letter Patent is:

1. An ammunition feeding system for a rapid-fire gun comprising, in combination:

A. a magazine having an entry and an exit;

B. an endless ammunition conveyor for conveying live ammunition rounds from said magazine via said exit to the rapid-fire gun and for conveying spent ammunition rounds back to said magazine via said entry;

C. means within said magazine between said entry and exit thereof for supporting said endless ammunition conveyor in a serpentine formation consisting of a multiplicity of serpentine conveyor loops;

D. a first shuttle mechanism stationed at said magazine exit, said first shuttle mechanism operating to successively unwrap said serpentine conveyor loops from said endless ammunition conveyor supporting means and to accelerate same to a conveyor gun firing rate velocity; and E. a second shuttle mechanism stationed at said magazine entry, said second shuttle mechanism operating in synchronism with said first shuttle mechanism to decelerate and successively wrap said endless ammunition conveyor into said serpentine conveyor loops on said endless ammunition conveyor supporting means.

2. The ammunition feeding system defined in claim 1, which further includes means for linearly conveying said serpentine formation of said endless ammunition conveyor from said magazine entry to said magazine exit at a velocity less than said conveyor gun firing rate velocity.

3. The ammunition feeding system defined in claim 2, wherein said supporting means supports each said serpentine conveyor loop of said endless ammunition conveyor serpentine formation at upper and lower support points.

4. The ammunition feeding system defined in claim 2, wherein said endless ammunition conveyor supporting means supports each said serpentine conveyor loop at the folds thereof.

5. The ammunition feeding system defined in claim 4, wherein said endless ammunition conveyor supporting means further supports each said serpentine loop at points intermediate said folds thereof.

6. The ammunition feeding system defined in claim 4, wherein said endless ammunition conveyor supporting means includes spaced, parallel sets of opposed rails extending between said magazine entry and exit, said rails supporting elements of said endless ammunition conveyor for linear conveyance by said linearly conveying means.

7. The ammunition feeding system defined in claim 4, wherein said first shuttle mechanism includes sets of first drive sprockets in driving engagement with said endless ammunition conveyor and means for reciprocating said first drive sprockets relative to said endless ammunition conveyor supporting means such as to pick successive said serpentine conveyor loops from said endless ammunition conveyor supporting means and accelerate same to said conveyor gun firing rate velocity.

8. The ammunition feeding system defined in claim 7, wherein said second shuttle mechanism includes sets of second drive sprockets in driving engagement with said endless ammunition conveyor and means for reciprocating said second drive sprockets relative to said endless ammunition conveyor supporting means such as to decelerate said endless ammunition conveyor and successively wrap said endless ammunition conveyor into said serpentine conveyor loops on said endless ammunition conveyor supporting means.

9. The ammunition feeding system defined in claim 8, wherein said endless ammunition conveyor includes a multiplicity of opposed roller elements distributed along the length thereof and engageably by said sets of first and second drive sprockets, and said endless ammunition conveyor supporting means includes spaced sets of opposed rails extending linearly between said magazine entry and exit, said rails supporting said conveyor roller elements at said folds of said serpentine conveyor loops.

10. The ammunition feeding system defined in claim 9, wherein said serpentine formation linearly conveying means includes separate conveying elements engaging those of said conveyor roller elements supported by said rails.

11. An ammunition feeding system for a rapid-fire gun comprising, in combination:

A. a magazine having an entry and an exit;

B. an endless conveyor for conveying live ammunition rounds from said magazine exit to the rapid-fire gun and conveying spent ammunition rounds to said magazine entry, said endless conveyor including a multiplicity of opposed roller elements distributed along the length thereof;

C. means mounted by said magazine for supporting a portion of said endless conveyor between said magazine entry and exit in a serpentine formation consisting of a plurality of serpentine conveyor loops, said endless conveyor supporting means including spaced sets of opposed, linear rails oriented to present aligned entry ends thereof at said magazine entry and aligned exit ends thereof at said magazine exit, said linear rails supporting said endless conveyor roller elements at the folds of said serpentine conveyor loops;

D. conveying means engaging said conveyor roller elements supported on said linear rails to linearly convey said serpentine formation of said endless conveyor toward said magazine exit and present successive said serpentine conveyor loops at said aligned exit ends of said linear rails;

E. a first shuttle mechanism stationed at said magazine exit, said first shuttle mechanism including first sets of drive sprockets drivingly engaging said conveyor roller elements and first means for reciprocating said first drive sprocket sets between said aligned exit ends of said linear rail spaced sets to successively unwrap said serpentine conveyor loops from said linear rails and accelerate said endless conveyor to a gun rapid-fire velocity; and F. a second shuttle mechanism stationed at said magazine entry, said second shuttle mechanism including second sets of drive sprockets drivingly engaging said conveyor roller elements and second means for reciprocating said second drive sprocket sets between said aligned entry ends of said linear rail spaced sets to decelerate said conveyor from said gun rapid-fire velocity and to rack said conveyor roller elements on said linear rails, whereby to successively wrap said endless conveyor into said serpentine conveyor loops of said serpentine formation.

12. The ammunition feeding system defined in claim 11, wherein said endless conveyor supporting means includes an additional set of opposed linear rails for supporting said conveyor roller elements of said serpentine conveyor loops at points intermediate said folds thereof.

13. The ammunition feeding system defined in claim 11, wherein said conveying means includes separate, commonly driven screw feeder elements mounted in proximate, substantially coextensive relation with said linear rails, said screw feeder elements conveyingly engaging said conveyor roller elements supported on said linear rails.

14. The ammunition feeding system defined in claim 11, wherein said first shuttle mechanism further includes a first set of accumulator sprockets about which said endless conveyor is trained leading from said first drive sprocket sets, said first accumulator sprocket sets being mounted for reciprocation in coordination with said first drive sprocket sets.

15. The ammunition feeding system defined in claim 14, wherein said second shuttle mechanism further includes a second set of accumulator sprockets about which said endless conveyor is trained leading to said second sets of drive sprockets, said second set of accumulator sprockets being mounted for reciprocation in coordination with said second sets of drive sprockets.

16. The ammunition feeding system defined in claim 15, wherein said first and second reciprocating means respectively reciprocate said first and second sets of drive sprockets in synchronous, in-phase relation.

17. The ammunition feeding system defined in claim 16, wherein said first and second shuttle mechanisms each include separate third means for drivingly reciprocating said first and second sets of accumulator sprockets in coordination with and at half the rate and half the stroke length of said first and second sets of drive sprockets.

18. The ammunition feeding system defined in claim 17, wherein said conveying means includes separate, commonly driven screw feeder elements mounted in proximate, substantially coextensive relation with said linear rails, said screw feeder elements conveyingly engaging said conveyor roller elements supported on said linear rails.

19. The ammunition feeding system defined in claim 18, wherein said first and second reciprocating means each include a pair of opposed internal racetrack-shaped gears and follower gears affixed on opposed ends of one drive sprocket shaft of each of said first and second drive sprocket sets in meshing engagement with said racetrack-shaped gears, whereby driven rotations of said one drive sprocket shafts produce both rotation and reciprocation of the drive sprockets of said first and second drive sprocket sets carried by said one drive sprocket shafts.

20. The ammunition feeding system defined in claim 19, wherein each said first and second shuttle mechanisms includes a drive shaft, first gearing drivingly connecting said drive shaft to the said one drive sprocket shaft of said drive sprocket sets, second gearing drivingly connecting said drive shaft to each of said screw feeder elements, and third gearing drivingly connecting said drive shaft to said third means for reciprocating said accumulator sprocket set, said drive shafts of said first and second shuttle mechanisms being drivingly interconnected.

* * * * *